US006245245B1

(12) United States Patent
Sato

(10) Patent No.: US 6,245,245 B1
(45) **Date of Patent: *Jun. 12, 2001**

(54) METHOD FOR MANUFACTURING AN INK JET HEAD

(75) Inventor: Tamaki Sato, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/098,327

(22) Filed: Jun. 17, 1998

(30) Foreign Application Priority Data

Jun. 20, 1997 (JP) ..... 9-164198

(51) Int. Cl.[7] ..... C23F 1/00
(52) U.S. Cl. ..... 216/27
(58) Field of Search ..... 216/27; 346/1.1

(56) References Cited

U.S. PATENT DOCUMENTS

| | | | | |
|---|---|---|---|---|
| 4,412,224 | * | 10/1983 | Sugitani | 346/1.1 |
| 5,030,970 | | 7/1991 | Drake et al. | 346/140 R |
| 5,443,687 | * | 8/1995 | Kayana et al. | 216/27 |
| 5,608,436 | | 3/1997 | Baughman et al. | 347/65 |

FOREIGN PATENT DOCUMENTS

| | | | |
|---|---|---|---|
| 0750992 | | 1/1997 | (EP) . |
| 0775581 | | 5/1997 | (EP) . |
| 57-116656 | * | 7/1982 | (JP) . |
| 4-002790 | * | 1/1992 | (JP) . |
| 9-207341 | * | 8/1997 | (JP) . |

* cited by examiner

*Primary Examiner*—Gregory Mills
*Assistant Examiner*—Rudy Zervigon
(74) *Attorney, Agent, or Firm*—Fitzpatrick, Cella, Harper & Scinto

(57) ABSTRACT

A method for manufacturing an ink jet head comprises the steps of preparing a substrate for use, forming a mask layer of etching-proof material for the formation of an ink supply opening at least on one surface of the substrate, forming the hole serving as the ink supply opening by executing anisotropic etching on the substrate through the mask layer of etching-proof material, and removing by means of wet etching the eaves-like portions formed by the side etching following the anisotropic etching on the mask layer of etching-proof material on the circumference of the hole and the surface of the mask layer of etching-proof material on the substrate. With this method, it becomes possible to prevent the interior of head from being contaminated by the dust particles that may be created by the broken eaves-like portions and by the water used for dicing that may enter the interior of head in the processes subsequent to etching for head manufacture.

8 Claims, 3 Drawing Sheets

METHOD FOR MANUFACTURING AN INK JET HEAD

BACKGROUND OF THE INVENTION

1. Field of the Invention

The present invention relates to a method for manufacturing an ink jet head for discharging small droplets of printing "ink" (hereinafter referred to as ink) used for a liquid jet (hereinafter referred to as an "ink jet") printing method.

2. Related Background Art

The noises generated in printing by use of the ink jet printing method are small enough to be negligible. Also, with the adoption of this method, it is possible to print at high speeds on sheets of so-called ordinary paper without any particular or special treatment of the paper. As a result, this printing method has been rapidly in wide use in recent years.

Now, among ink jet heads using this method, there is known an ink jet head of the so-called side-shooter type that discharges ink in the direction perpendicular to the substrate having energy generating elements formed on it for generating energy which is utilized for discharging ink. As one structural example of the side shooter type head, it is generally practiced to form the ink supply opening through the substrate having the energy generating elements arranged on the surface thereof. The ink supply opening is provided for supplying ink to the ink flow paths having the energy generating elements in them, respectively. As the formation method of this ink supply opening, there are known mechanical means, such as drilling; means for using optical energy, such as a laser; or means for using chemical methods, such as etching, among some others.

Of these means and method, anisotropic etching is well known as a chemical etching method. In other words, when an alkaline chemical etching is executed on a silicon substrate (wafer) having the crystal plane orientations of <100>, <110> planes, directional selectivity may take place as the etching progresses in accordance with the crystal plane orientations. Then, anisotropy becomes obtainable as between the depth (engraving) direction and the width (expanding) direction of the etching. For example, with use of a silicon substrate provided with the <100> plane of the crystal plane orientations, it becomes possible to control the width of ink supply opening just by the initial width of opening where the etching begins, because the depth direction is geometrically determined. More specifically, as shown in FIG. 2D or FIG. 2E, it is possible to obtain the bottom face that has become narrower with a surface (formed by etching) at an inclination of 54.7° in the depth direction from the etching initiation surface. In this respect, therefore, with the thickness of the substrate 1 and the etching width being taken into consideration, control can be easily made as to the width of the opening on the side opposite to the etching initiation surface of the substrate, that is, the width of the ink supply opening. Here, in FIGS. 2A to 2E, reference numeral 1 designates a substrate; 2, an etching suspension membrane; and 3, the formation member of ink flow paths, respectively. Also, reference numeral 4 designates a mask layer formed by etching-proof material, and 5, an ink supply opening.

An alkaline chemical etching of the kind is, roughly speaking, conducted for a comparatively long time using its strong alkali. Then, conventionally, a silicon oxide or other dielectric membrane is used as the mask layer 4 of etching-proof material in order to carry out heat treatment.

Here, for the mask pattern formation on this mask material, the techniques conventionally used for patterning the silicon oxide or other dielectric membrane, may be used. For example, there is known a wet etching that uses a mixed solution of hydrofluoric acid and ammonium fluoride, a dry etching that uses reaction gas, or the like.

Also, for the execution of the anisotropic etching, attention should be given so as not to allow etching solution to be in contact with the plane (surface) on the side opposite to the etching initiation plane, as such contact this may create a problem. Here, some means should be provided, such as a jig that uses an O-ring or an etching-proof rubber resist for protection.

Now, with the anisotropic etching, its etching progress is not only directed toward the depth (engraving) direction, but also, toward the width (expanding) direction (hereinafter referred to as side etching). As a result, some of the silicon oxide serving as the mask layer formed by etching-proof material may, in some cases, remain floating in the form of overchanging or projecting eaves (as at 8 in FIG. 2C or in FIG. 2F). When an ink supply opening 5 is formed in such a manner, the eaves 8 that have been created by the side etching may be broken in the subsequent processes of recording head manufacture, such as assembling or fabrication following the post-processing of the formation of the ink supply opening 5. There is a risk that these broken eaves pieces may lead to the creation of dust particles.

Therefore, means should be provided to remove the silicon oxide which remains in the form of eaves 8 after the formation of the ink supply opening. Here, for the removal thereof, it is possible to use the same technique as the one adopted for patterning as described earlier, together with the removal of other portions of the silicon membrane. In this case, however, there is a possibility that the mixed solution of hydrofluoric acid and ammonium fluoride used for this technique may present a problem with respect to the plane (surface of the substrate) on the side opposite to the anisotropic etching initiation plane. Then, for protection, a jig or some other means should be used so as not to allow the mixed solution or reaction gas to be in contact with the surface of the substrate. Here, for this means, it may be possible to share the protection means used for the anisotropic etching applicable to the formation of the ink supply opening. However, for the application of this means, there is a need for the provision of protection to cover the edge portion of a wafer, and also, to cover even the circumference of the etching initiation plane side in order to prevent the etching solution from being spread to the reverse side of the substrate. As a result, the silicon oxide membrane on the portions covered by the protection member 6 on the anisotropic etching initiation plane, tend to remain as they are even in the removal process that uses the mixed solution or reaction gas described earlier. Each of such remaining portions may create steps eventually in the processing that follows the etching.

Now, the detailed description will be given as below with reference to FIGS. 2A to 2G.

When an ink jet head is produced by means of anisotropic etching, a problem is encountered as described earlier if etching solution is allowed to be in contact with the surface of the substrate on the side opposite to the etching initiation plane, because on the surface there are formed the energy generating elements for use of discharging ink and an orifice plate member, and others. Here, therefore, on the reverse side of the substrate 1 where the etching terminates, a membrane 2 that contains at least silicon nitride is filmed in order to enable the anisotropic etching to be suspended on this membrane 2. Then, after having processed the ink supply opening 5 by means of etching (see FIG. 2D), this membrane 2 is removed by means of plasma dry etching using reaction gas, such as $CF_4$ gas, from the reverse side of the substrate as shown in FIG. 2E.

However, in the process of removing the membrane 2, the larger portion on the silicon surface 1A, where no silicon oxide membrane remains on the reverse side of the substrate, is etched by the aforesaid $CF_4$ gas as shown in FIG. 2G. Thus, a step 7 is created between this etched surface 1A and the surface which is not etched due to the remaining silicon oxide 4 as described earlier.

Now, in this respect, when the substrate is cut and separated in the following ink jet head manufacture processes, water used for such cutting enters each of the steps, which causes the creation of dust particles in the flow paths of each head thus produced.

SUMMARY OF THE INVENTION

The present invention is designed in consideration of the problems described above. It is an object of the invention to provide a method for manufacturing a highly reliable ink jet head in which the mask layer of etching-proof material is removed incompletely when forming the ink supply opening, and also, to provide an ink jet head, and an ink jet printing apparatus as well.

In order to achieve the objectives described above, a method of manufacture of the present invention comprises the steps of preparing a substrate for use of an ink jet head; forming a mask layer of etching-proof material for the formation of an ink supply opening at least on one surface of the substrate; forming the hole serving as the ink supply opening by executing anisotropic etching on the substrate through the mask layer of etching-proof material; and removing, by means of wet etching, the eaves-like portions formed by the side etching following the anisotropic etching on the mask layer of etching-proof material on the circumference of the hole and the surface of the mask layer of etching-proof material on the substrate.

With the structure thus arranged, it is possible to remove the mask layer of etching-proof material used for the formation of hole by use of the anisotropic etching on the substrate, which may, for example, serve as the ink supply opening or the like, but allowing such layer to remain in a specific thickness. As a result, when the anisotropic etching stop layer is removed by etching subsequent to the removal process of the aforesaid mask layer, the existence of the remaining mask layer makes it possible to prevent any erosion from being caused by this particular etching on the reverse side of the substrate. Therefore, it becomes possible to prevent the interior of head from being contaminated by the dust particles that may be created by the broken eaves-like portions or through the steps formed on the reverse side of the substrate due to erosion in the processes of head manufacture following the etching.

Also, there is another effect. When an ink liquid having a weak alkaline property is used, the remaining silicon oxide membrane functions to suppress the elution of silicon into the weak alkaline ink, thus preventing scorching due to the eluated silicon.

Further, when an ink jet head is assembled after the silicon substrate is cut and separated, the silicon oxide surface and an ink supply member can be bonded more stably.

Consequently, it is possible to obtain a highly reliable and durable ink jet head which is capable of providing prints with high quality.

DETAILED DESCRIPTION OF THE PREFERRED EMBODIMENTS

Hereinafter, with reference to the accompanying drawings, the detailed description will be made of the embodiment in accordance with the present invention.

FIGS. 1A to 1E are views which schematically illustrate the processes of the ink jet head manufacture in accordance with one embodiment of the present invention. FIG. 1F and FIG. 1G are views which schematically illustrate parts of such processes in detail.

At first, on the surface of a substrate 1, a membrane 2 which contains at least silicon nitride is formed as the anisotropic etching stop layer. Further on this membrane 2, a member 3 is provided for the formation of heat generating elements (not shown) that generate thermal energy utilized for discharging ink, and ink flow paths, as well as orifices (discharge ports) (see FIG. 1A).

Figure 1A:
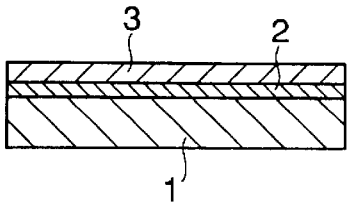
FIGS. 1A, 1B, 1C, 1D, 1E, 1F and 1G are views which schematically illustrate the processes of an ink jet head manufacture in accordance with one embodiment of the present invention.
Figure 1B:
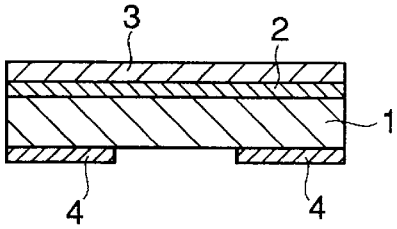

In continuation, as shown in FIG. 1B, a silicon oxide membrane 4 is formed on the reverse side of the substrate as the etching-proof mask for use of the anisotropic etching. After that, the silicon oxide membrane 4 is etched to pattern the ink supply opening 5. As means for this etching, there is generally adopted the known method that uses a mixed solution of hydrofluoric acid and ammonium fluoride or the dry etching method that uses reaction gas. In this case, if the aforesaid mixed solution is used as an etching means, it is necessary to protect the wafer edges and the circumference of the anisotropic etching initiation plane side with a protection film formed by etching-proof resist rubber (not shown) so as not to allow the mixed solution to come into contact with the surface of the substrate, and further, not to allow it to be permeated to the reverse side thereof.

Figure 1C:
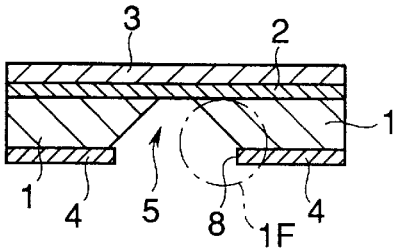

Then, as shown in FIG. 1C, anisotropic etching is executed for the formation of the ink supply opening 5. As the method of the anisotropic etching, alkaline etching solution, KOH, NaOH, TMAH, or other solution is used, and by setting its concentration and the treatment temperature appropriately, it becomes possible to establish the related etching speed and smoothness of the etching surface accordingly.

For this one embodiment, etching is carried out at the treatment temperature of 80° C. with TMAH 22 wt % with respect to the silicon substrate having the crystalline orientation of <100> plane. In this case, the etching is executed at an etching speed of 30 to 40 $\mu$m per hour. In this case, too, there is a need for protection so that no etching solution is in contact with the reverse side of the substrate. Here, the aforesaid protection film (rubber resist), which is used at the time of etching the silicon oxide membrane, can be shared for this use.

When this etching is executed, the direction of etching progress is not only toward the depth (engraving) direction, but also, toward the width (expanding) direction. Therefore, side etching takes place, which may cause floating portions of the silicon oxide membrane 4 serving as the mask layer of etching-proof material to remain in the form of eaves as shown in FIG. 1F.

For the embodiment described above, the amount of the side etching is approximately 50 to 60 $\mu$m per side. In this case, the silicon oxide 4 serving as the mask layer of etching-proof material remains in a length of 50 to 60 $\mu$m in the form of eaves.

Then, in order to prevent dust particles from being created, the silicon oxide membrane 4 is removed, together with the eaves-like remainders. As the removal method, wet etching is conducted with the mixed solution of hydrofluoric acid and ammonium fluoride. Here, when the eaves-like remainders are removed by means of the wet etching, it is possible to allow the etching solution to attack both the surface and reverse side of the eaves-like remainders unlike the usual etching. As a result, the removal is complete in approximately half the time required for the execution of the usual etching.

Figure 1D:
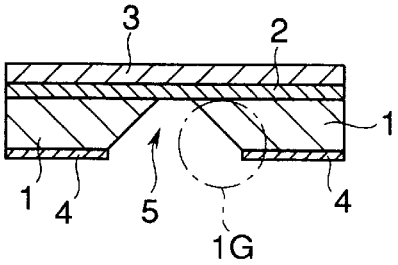

In accordance with the embodiment described above, the removal of the 7,000 Å silicon oxide membrane 4 is executed at the room temperature by use of the mixed solution of hydrofluoric acid/ammonium fluoride=1/10. Usually, in this condition, the silicon membrane 4 can be removed in 12 minutes completely. The eaves-like portions can be removed in six minutes, about half of the time required for removing the silicon membrane 4 (FIG. 1D and FIG. 1G). In other words, for the present embodiment, the removal processing is conducted only for a period of six minutes, which is good enough to remove the eaves portions 8 of the silicon oxide membrane 4 that serves as the etching-proof mask. Thus, the silicon oxide membrane 4 other than the eaves-like portion 8 is allowed to remain in a thickness of 3,500 Å.

Figure 1E:
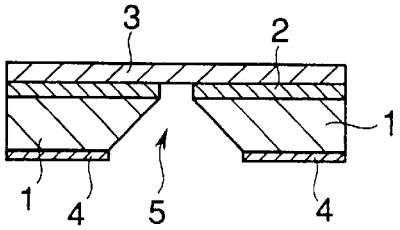
Figure 1F:
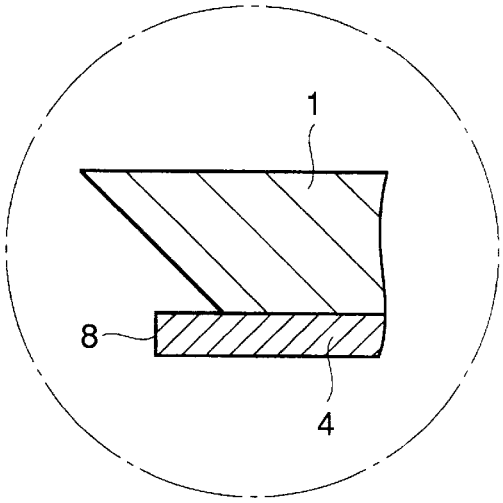
Figure 1G:
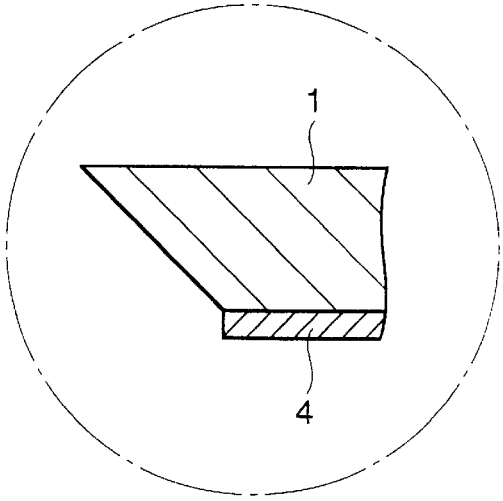

After that, the membrane 2 formed by silicon nitride, which serves as the anisotropic etching stop layer, is removed by use of plasma dry etching (FIG. 1E). The conditions are: output, 0.8 kW; pressure, 0.2 Torr; gas flow rate, $CF_4$: 300 sccm, $O_2$: 150 sccm, and $N_2$: 50 sccm; etching time, 40 minutes. The reverse side of the substrate 1 is not etched at all because of the existing silicon oxide membrane 4. As a result, there is no cutting water that enters the ink flow paths when the wafer is cut and separated after having peeled off the surface protection formed by the rubber resist.

Figure 2A:
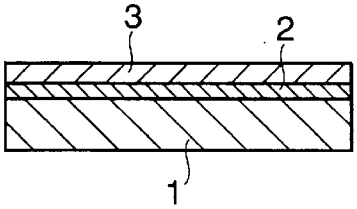
FIGS. 2A, 2B, 2C, 2D, 2E, 2F and 2G are views which schematically illustrate one conventional example of the method for manufacturing an ink jet head.
Figure 2B:
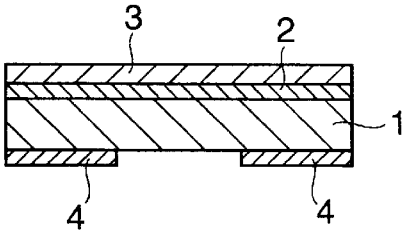
Figure 2C:
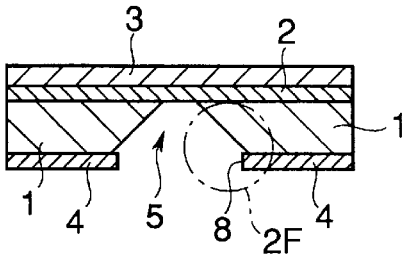
Figure 2D:
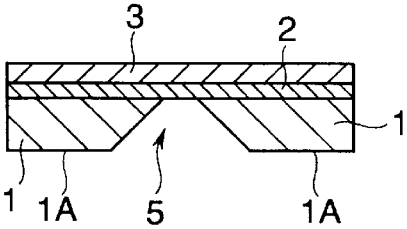
Figure 2E:
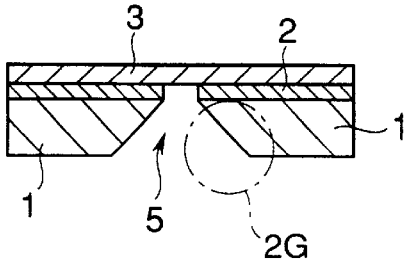
Figure 2F:
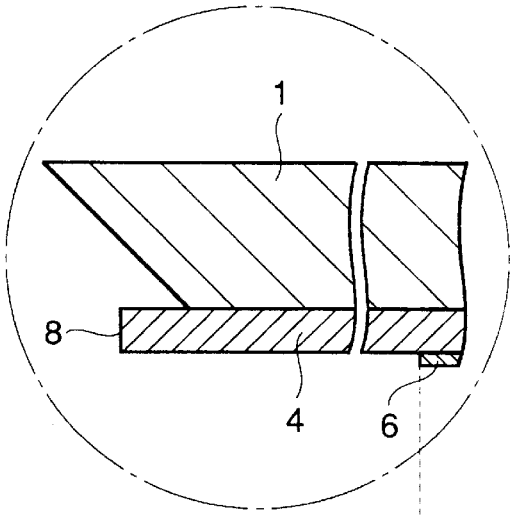
Figure 2G:
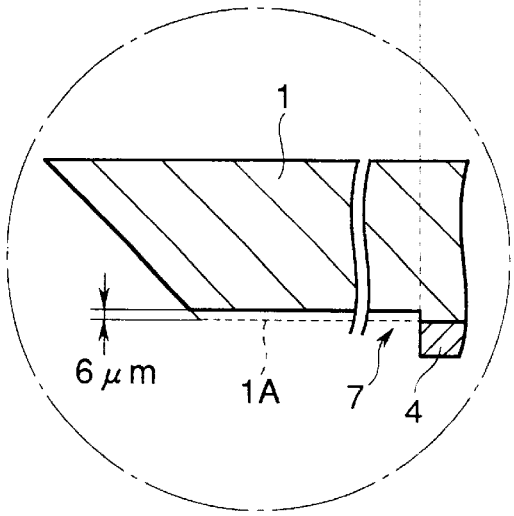

On the other hand, in accordance with the example of the conventional method of manufacture shown in FIGS. 2A to 2G, the removal of the silicon oxide membrane 4 on the reverse side of the substrate 1 is conducted for a period of 12 minutes (FIG. 2D) under the same conditions as in the embodiment described above. Further, the removal of the membrane 2 is conducted in the same condition (FIG. 2E), and the silicon substrate 1 is etched with the creation of a step of approximately 6 $\mu$m between the portion protected by the rubber resist 6 on the circumference of the wafer and the portion other than such protected portion (FIG. 2G). Then, when the wafer is cut and separated, cutting water enters the gap between the dicing tape and the substrate, with the dust particles therefore being detected in the ink flow paths or the like of the head thus produced.

Also, with the ink jet head manufactured in accordance with the present embodiment, printing is performed using the ink liquid which is composed by pure water/diethylene glycol/isopropyl alcohol/urea/black dye food black 2=74.5/15/5/3/2.5. As a result, prints are obtained with high quality.

In this respect, the aforesaid ink contains urea additionally as an agent to keep humidity for the purpose of preventing ink from being solidified in the ink discharge ports. This urea is dissolved as time elapses, and thus, the ink gradually develops a present weak alkaline property. However, the wall surface of the ink supply opening of the ink jet head obtained in the manner as described above still has the plane that is difficult to etch due to its anisotropy. Also, on the reverse side of the substrate, the silicon oxide membrane still remains. Nonetheless, there is almost no recognizable elution of silicon into the weak alkaline ink. It becomes possible to prevent scorching due to the eluted silicon. Further, there is almost no recognizable creation of dust particles.

In this respect, the formation process of orifices on the member 3 by use of laser or the like subsequent to the completion of processes represented in FIGS. 1A to 1G or other processes required before the completion of an ink jet head have all been known conventionally. Therefore, any related figures and description thereof will be omitted.

Figure 3:
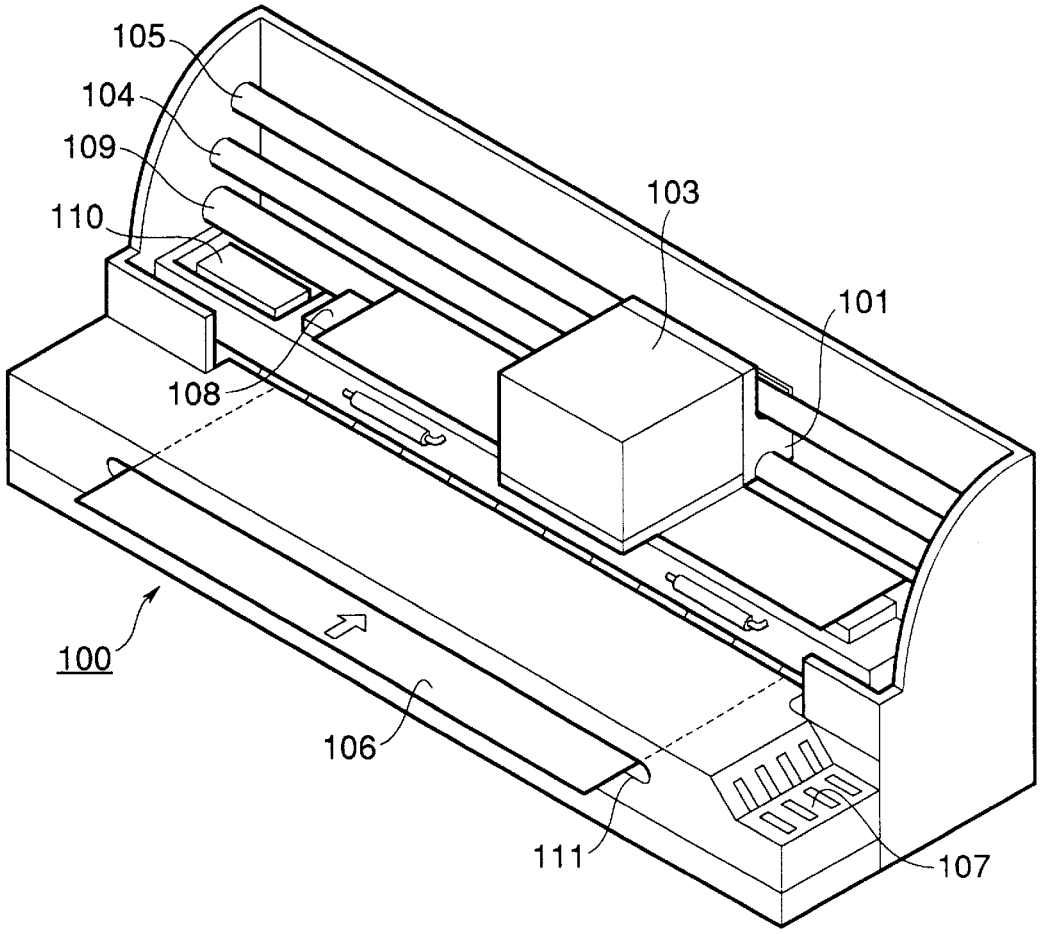
FIG. 3 is a perspective view which schematically shows an ink jet printing apparatus that uses the ink jet head manufactured in accordance with the embodiment represented in FIGS. 1A to 1G.

Now, FIG. 3 is a perspective view which schematically shows one example of the ink jet printing apparatus using the ink jet head manufactured by the method of manufacture described above.

For the ink jet printing apparatus 100, a carriage 101 engages slidably with two guide shafts 104 and 105 which extend parallel to each other. In this manner, the carriage 101 can move along the guide shafts 104 and 105 by means of a driving motor and a driving power transmission mechanism, such as a belt and other elements that transmit the driving power (neither of them shown). On the carriage 101, there is mounted an ink jet unit 103 provided with ink jet heads obtainable in the manner as described above together with ink containers that contain ink to be used for such head. This ink jet unit 103 comprises the heads that discharges ink and the tanks that contains ink to be supplied to each of the heads, that is, four heads, each discharging black (Bk), cyan (C), magenta (M), and yellow (Y) ink, respectively, with the tanks being arranged correspondingly for each of the heads. The ink jet unit 103 thus structured is mounted on the carriage 101. Here, each of the heads and tanks are mutually detachably mountable. It is also arranged that when ink in any one of the tanks has been consumed, only the tank can be replaced as required per ink color. It is of course possible to replace heads alone as required. Here, however, the structure that allows the heads and tanks to be detachably mounted is not necessarily limited to the example described above. It is of course possible to form them together as one body.

When printing, the paper sheet 106 that serves as a printing medium is inserted into the insertion opening 111 arranged on the front end of the apparatus, but its conveying direction is reversed ultimately. The paper sheet is being conveyed by means of a feeding roller 109 underneath the moving range of the carriage 101. In this way, with the head mounted on the carriage 101, printing is executed along with the movement of the carriage on the printing area of the paper sheet supported by a platen 108.

As described above, printing in a width corresponding to the width of the arrangement of discharge ports of the head along with the movement of the carriage 101 and the feeding of the paper sheet are alternately repeated. The operation of the kind is repeated to print on the entire area of the paper sheet 106. Then, the paper sheet 106 is expelled in front of the apparatus.

On the left end of the movable region of the carriage 101, a recovery system unit 110 is arranged in such a manner that it can face each of the heads on the carriage and the lower part thereof. With this unit, it is made possible to cap the discharge ports of each head and to operate the suction of ink from each of the discharge ports of the respective heads, among some others, when recording is at rest. Also, a specific position on the left end of the carriage movable region is established as the home position of the heads.

Meanwhile, on the right end of the apparatus, an operation unit 107 is arranged with switches and indication elements. The switches arranged for the operation unit are used for turning on or off the source of electric-supply on the apparatus and setting various printing modes as well. The indication elements function to indicate various conditions of the apparatus.

Now, as has been described above, in accordance with the present invention, it is arranged to remove the mask layer of etching-proof material used for forming the ink supply opening or the like, for example, on the substrate by means of the anisotropic etching, but allowing the mask layer to remain in a specific thickness. Therefore, when etching is conducted to remove the etching stop layer subsequent to the removal of the aforesaid mask layer, there is no possibility of erosion taking place on the reverse side of the substrate by that particular etching, because of the remainder of the mask layer. As a result, it becomes possible to prevent the interior of head from being contaminated by the dust particles that may be created by the broken eaves-like portions or through the steps formed on the reverse side of the substrate due to erosion in the processes of head manufacture following the etching.

Also, as another effect, it is possible to prevent scorching due to the silicon that may be eluted in ink, if an ink liquid used has a weak alkaline property, because the remaining silicon oxide membrane functions to suppress the elution of silicon into such weakly alkaline ink.

Further, when an ink jet head is assembled after the silicon substrate is cut and separated, the silicon oxide surface and an ink supply member can be bonded more stably.

Consequently, it is possible to obtain an highly reliable and durable ink jet head which is capable of providing prints in high quality.

What is claimed is:

1. A method for manufacturing an ink jet head, comprising the steps of:

preparing a substrate for use of an ink jet head;

forming a mask layer of etching-proof material for the formation of an ink supply opening at least on one surface of the substrate;

forming a hold swerving as the ink supply opening by executing anisotropic etching on the substrate through the mask layer of etching-proof material; and removing by wet etching an eaves-like portion formed by a side etching following said anisotropic etching on the mask layer of etching-proof material on the circumference of the hole and a surface of the mask layer of etching-proof material on the substrate.

2. A method for manufacturing an ink jet head according to claim 1, wherein, on the side of the substrate opposite to the formation surface of the mask layer of etching-proof material, an etching stop layer is provided, at the same time, said method for manufacturing an ink jet head further comprising the step of removing the etching stop layer.

3. A method for manufacturing an ink jet head according to claim 1, wherein after the surface of the mask layer of etching-proof material is removed by said wet etching, the layer thickness of the layer is 30% or more of the layer thickness of the layer before said wet etching is executed.

4. A method for manufacturing an ink jet head according to claim 1, wherein heat generating elements are formed on the substrate for generating thermal energy utilized for discharging ink.

5. A method for manufacturing an ink jet head according to claim 1, wherein the ink jet head is structured to discharge ink in a direction perpendicular to the substrate.

6. A method for manufacturing an ink jet head according to claim 1, wherein the substrate is formed by silicon, and the crystal plane orientation of the silicon is <100> plane or <110> plane.

7. A method for manufacturing an ink jet head according to claim 1, wherein said wet etching process uses a mixed solution of hydrofluoric acid and ammonium fluoride.

8. A method for manufacturing an ink jet head according to claim 1, wherein the mask layer of etching-proof material is formed by silicon oxide.

* * * * *

UNITED STATES PATENT AND TRADEMARK OFFICE

CERTIFICATE OF CORRECTION

PATENT NO. : 6,245,245 B1
DATED : June 12, 2001
INVENTOR(S) : Tamaki Sato

It is certified that error appears in the above-identified patent and that said Letters Patent is hereby corrected as shown below:

Title page,
Item [56], References Cited,
U.S. PATENT DOCUMENTS, "5,030,970" should read -- 5,030,971 --

Column 1,
Line 8, ""ink"" should read -- ink --; and "ink)" should read -- "ink") --; and
Line 24, "side shooter" should read -- side-shooter --.

Column 2,
Line 17, "side etching)." should read -- "side etching"). --.

Column 5,
Line 59, "the" (third occurrence) should de deleted.

Column 6,
Line 35, "discharges" should read -- discharge --; and "contains" should read -- contain --.

Column 8,
Line 1, "of an" should read -- in an --; and
Line 5, "hold swerving" should read -- hole serving --.

Signed and Sealed this

Ninth Day of April, 2002

*Attest:*

*Attesting Officer*

JAMES E. ROGAN
*Director of the United States Patent and Trademark Office*